US009074373B2

(12) United States Patent
Stahl

(10) Patent No.: US 9,074,373 B2
(45) Date of Patent: Jul. 7, 2015

(54) SYSTEM, METHOD AND APPARATUS FOR ADDING THICKNESS TO ROOFING PRODUCTS

(71) Applicant: CertainTeed Corporation, Valley Forge, PA (US)

(72) Inventor: Kermit E. Stahl, North Wales, PA (US)

(73) Assignee: CertainTeed Corporation, Valley Forge, PA (US)

( * ) Notice: Subject to any disclaimer, the term of this patent is extended or adjusted under 35 U.S.C. 154(b) by 0 days.

(21) Appl. No.: 14/189,049

(22) Filed: Feb. 25, 2014

(65) Prior Publication Data

US 2014/0245690 A1 Sep. 4, 2014

Related U.S. Application Data

(60) Provisional application No. 61/772,005, filed on Mar. 4, 2013.

(51) Int. Cl.

| | |
|---|---|
| ***E04D 1/34*** | (2006.01) |
| ***E04D 11/02*** | (2006.01) |
| ***E04D 1/26*** | (2006.01) |
| ***E04D 1/30*** | (2006.01) |

(52) U.S. Cl.
CPC *E04D 11/02* (2013.01); *E04D 1/26* (2013.01); *E04D 1/30* (2013.01)

(58) Field of Classification Search
CPC ..... E04D 11/02; E04D 1/26; E04D 1/30
USPC ..... 52/547, 518, 543, 545, 549, 550, 551
See application file for complete search history.

(56) References Cited

U.S. PATENT DOCUMENTS

| | | | | |
|---|---|---|---|---|
| 1,601,731 | A | 10/1926 | Flood | |
| 1,709,376 | A | 4/1929 | Shirley | |
| 4,586,309 | A | 5/1986 | Ferguson | |
| 4,869,942 | A * | 9/1989 | Jennus et al. | 428/77 |
| 5,347,785 | A | 9/1994 | Terrenzio | |
| 5,488,807 | A | 2/1996 | Terrenzio | |
| 6,361,851 | B1 | 3/2002 | Sieling et al. | |
| 6,467,235 | B2 | 10/2002 | Kalkanoglu et al. | |
| 6,510,664 | B2 | 1/2003 | Kupczyk | |
| 6,920,730 | B2 | 7/2005 | Becker et al. | |
| 7,578,108 | B2 * | 8/2009 | Swanson | 52/540 |
| 7,781,046 | B2 | 8/2010 | Kalkanoglu et al. | |
| 7,805,905 | B2 | 10/2010 | Rodrigues et al. | |
| 7,833,371 | B2 | 11/2010 | Binkley et al. | |
| 8,266,861 | B2 | 9/2012 | Koch et al. | |
| 8,276,329 | B2 | 10/2012 | Lenox | |
| 8,281,520 | B2 | 10/2012 | Quaranta et al. | |
| 8,302,358 | B2 * | 11/2012 | Kalkanoglu | 52/314 |
| 8,316,608 | B2 | 11/2012 | Binkley et al. | |
| 8,365,493 | B2 | 2/2013 | Jenkins | |
| 8,592,025 | B2 | 11/2013 | Kalkanoglu et al. | |
| 2003/0196389 | A1 * | 10/2003 | Naipawer, III | 52/57 |
| 2004/0123545 | A1 * | 7/2004 | Phillips | 52/535 |

(Continued)

*Primary Examiner* — Mark Wendell
(74) *Attorney, Agent, or Firm* — Abel Law Group, LLP; Alexander H. Plache

(57) ABSTRACT

A roofing accessory adds thickness to a roofing product. A roofing system includes a roofing shingle secured to a roof deck as an outermost layer of the roof. The roofing accessory is secured between the roofing shingle and a previous course of roofing shingle for adding a thickness of at least about 1.5 mm to at least a portion of an exposed edge of the roofing shingle.

18 Claims, 13 Drawing Sheets

(56) References Cited

U.S. PATENT DOCUMENTS

| | | | | |
|---|---|---|---|---|
| 2009/0100788 | A1 | 4/2009 | Gabbard et al. | |
| 2009/0151288 | A1 | 6/2009 | Kalkanoglu et al. | |
| 2010/0218433 | A1 | 9/2010 | Quaranta et al. | |
| 2010/0239807 | A1 | 9/2010 | Grubka et al. | |
| 2010/0266811 | A1 | 10/2010 | Kalkanoglu et al. | |
| 2011/0056148 | A1 | 3/2011 | Jenkins et al. | |
| 2011/0061326 | A1 | 3/2011 | Jenkins | |
| 2012/0260597 | A1* | 10/2012 | Jenkins et al. | 52/518 |
| 2012/0266559 | A1 | 10/2012 | Thies, III | |
| 2012/0288674 | A1* | 11/2012 | Botke | 428/141 |

* cited by examiner

SYSTEM, METHOD AND APPARATUS FOR ADDING THICKNESS TO ROOFING PRODUCTS

The present application claims priority from U.S. Provisional Application No. 61/772,005, filed Mar. 4, 2013, entitled "System, Method And Apparatus For Adding Thickness To Roofing Products" naming inventor Kermit E. Stahl, which application is incorporated by reference herein its entirety.

BACKGROUND OF THE INVENTION

1. Field of the Disclosure

The present invention relates in general to roofing and, in particular, to a system, method and apparatus for adding thickness to roofing products.

2. Description of the Related Art

Typical residential roofs in North America have bitumen-based roofing materials, such as asphalt shingles, that provide satisfactory water shedding, long term durability and have aesthetic appeal. An advantage of using these types of shingle roofing products is lower cost over more expensive natural materials, such as quarried slate, split wood or sawn shakes. Such natural materials have an inherent and desired thickness. However, traditional asphalt roofing products are much thinner, but lower in weight than such natural materials. It would desirable to combine the benefits of asphalt shingles with a desired edge thickness and look of natural wood or sawn shakes. Such a roofing product would simulate the shape and appearance of real wood or sawn shakes, while conserving natural materials and allowing efficient packaging to the job site. Thus, improvements in roofing products continue to be of interest.

SUMMARY

Embodiments of a system, method and apparatus for adding thickness to a roofing product are disclosed. For example, a roofing system may comprise a roofing shingle configured to be secured to a roof deck as an outermost layer of a roof. An accessory may be configured to be secured between the roofing shingle and a previous course of roofing shingle for adding a thickness of at least about 1.5 mm to at least a portion of an exposed edge of the roofing shingle.

Embodiments of a method of installing a roof may comprise placing an accessory in a location where a next roofing shingle is to be installed. The method may include installing the next roofing shingle on top of the accessory, such that the accessory adds a thickness of at least about 1.5 mm to at least a portion of the exposed edge of the roofing shingle. The method may then include repeating these steps for each roofing shingle.

Embodiments of a roofing kit may comprise a plurality of roofing accessories that are not roofing shingles and are not an outermost layer of a roofing system. Each of the roofing accessories may be configured to be secured between a roofing shingle and a previous course of roofing shingle for adding a thickness of at least about 1.5 mm to at least a portion of an exposed edge of the roofing shingle.

In still other embodiments, a roofing product may comprise a roofing accessory that is not a roofing shingle and is not an outermost layer of a roof. The roofing accessory may be configured to be secured between a roofing shingle and a previous course of roofing shingle for adding a thickness of at least about 1.5 mm to at least a portion of an exposed edge of the roofing shingle.

The foregoing and other objects and advantages of these embodiments will be apparent to those of ordinary skill in the art in view of the following detailed description, taken in conjunction with the appended claims and the accompanying drawings.

BRIEF DESCRIPTION OF THE DRAWINGS

So that the manner in which the features and advantages of the embodiments are attained and may be understood in more detail, a more particular description may be had by reference to the embodiments thereof that are illustrated in the appended drawings. However, the drawings illustrate only some embodiments and therefore are not to be considered limiting in scope as there may be other equally effective embodiments.

The use of the same reference symbols in different drawings indicates similar or identical items.

DETAILED DESCRIPTION

Figure 1A:
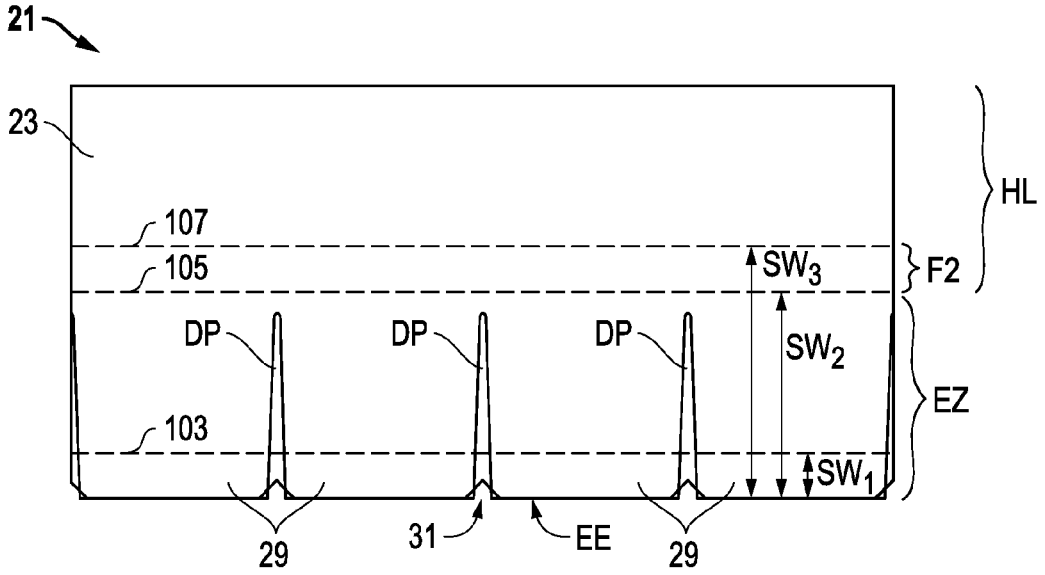
FIGS. 1A, 1B and 1C are schematic top, edge and sectional side views of embodiments of a roofing system.

Embodiments of a system, method and apparatus for adding thickness to a roofing product are disclosed. For example, a roofing system 21 (see, e.g., FIGS. 1A-1C) may comprise a roofing shingle 23 configured to be secured to a roof deck 25 as an outermost layer of a roof. The roofing shingle 23 may include one or more layers and has an exposed edge EE. The roofing shingle 23 may have a thickness Ts, such as a thickness Ts of about 2 mm to about 3 mm, or even about 4 mm, in some versions.

The roofing system 21 may further comprise an accessory 31 or roofing accessory configured to be secured between the roofing shingle 23 and a previous course 27 (FIG. 1C) of roofing shingle 23. The accessory 31 also may be located between and in direct contact with the roof deck 25 and the roofing shingle 23. Embodiments of the accessory 31 are not a part of and are not connected to the roofing shingle 23. For example, the accessory 31 may contact the roofing shingle 23 only upon installation of the roofing shingle 23.

The accessory 31 may be provided for adding additional thickness to at least a portion of the exposed edge EE of the roofing shingle 23 that it underlies. Embodiments of the accessory 31 may have a surface area that is smaller than a surface area of the roofing shingle 23. For example, the accessory may have a width (W) that is less than a width of the roofing shingle 23. In other embodiments, the lowermost edge of the accessory 31 may protrude beyond the exposed edge EE, or be recessed from the exposed edge EE of the roofing shingle 23. The accessory 31 may be thicker, thinner or the same thickness compared to the roofing shingle 23. For example, the thickness Ta of accessory 31 may be at least about 1.5 mm, such as at least about 3 mm, at least about 5 mm, at least about 8 mm, or even at least about 11 mm. The thickness Ta of accessory 31 also may be within a range between any of these minimum and maximum values. In some versions, the thickness Ta of accessory 31 exceeds the thickness of conventional underlayment roofing materials such as wraps and shielding, which are typically provided in rolls of thin material having a thickness of less than about 1.5 mm. In other versions, the thickness Ta of the accessory 31 also may be provided as approximately an integer multiple of a thickness of the roofing shingle 23. In still other versions, the thickness Ta of the accessory 31 may be another thickness that is not an integer multiple of the shingle thickness Ts.

The accessory 31 may be provided with an exposed edge EE along an edge thickness (e.g., thickness Ta) thereof. In some versions, only the exposed edge EE of the accessory 31 is exposed to an exterior of the roofing system 21. The exposed edge EE of the accessory 31 may substantially conform in shape to the exposed edge EE of the roofing shingle 23, or it may be different.

Some embodiments of the accessory 31 are not configured to be the outermost layer of the roof. For example, some versions of the accessory 31 are not a roofing shingle and are not suitable for use as such. Other versions of the accessory 31 are not a starter shingle. The term "starter shingle" may be defined as an initial course of specialized roof shingle only intended to be used at a lowermost portion (adjacent the eave) of the roof of a building. Starter shingles typically are completely covered by conventional roofing shingles and are provided with a top adhesive to secure them to the conventional roofing shingles.

In other embodiments, the accessory 31 may comprise materials similar to those of the roofing shingle 23, such as conventional materials for conventional roofing shingles. For example, the accessory 31 may comprise another roofing shingle 23, although the accessory 31 may vary in at least one aspect with respect to the roofing shingle 23.

Embodiments of the accessory 31 may comprise a thickness enhancing portion (e.g., thickness Ta) beneath the at least a portion of the exposed edge EE of the roofing shingle 23. Versions of the thickness enhancing portion Ta may not be exposed to an exterior of the roofing system 21, such that they are substantially covered by the roofing shingle 23. For example, in some versions only one or more decorative portions DP (FIG. 1A) of the accessory may be exposed from the exterior of the roofing system 21. The decorative portion DP of accessory 31 may be exposed through a slit, slot or cut out in the roofing shingle 23.

Other embodiments of the accessory 31 may be configured to be used with a plurality of different types of roofing shingles 23, wherein each of the shingles 23 differ from the others in at least one aspect. For example, the at least one aspect of the shingles 23 may comprise color, style, shape, dimension, or a combination thereof. This feature allows a single type of accessory 31 to be used with different types of roofing shingles 23, even though the different types of roofing shingles 23 are dissimilar.

Figure 1B:
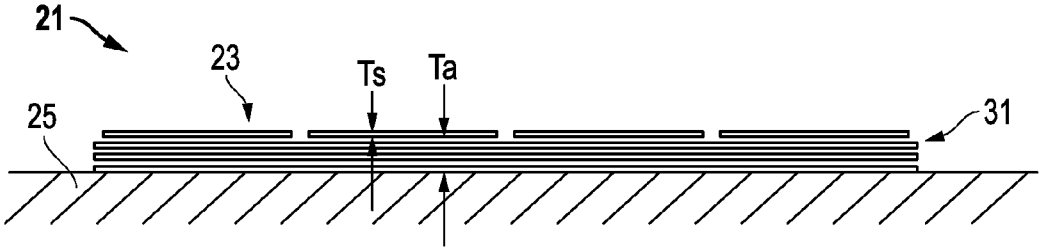
Figure 1C:
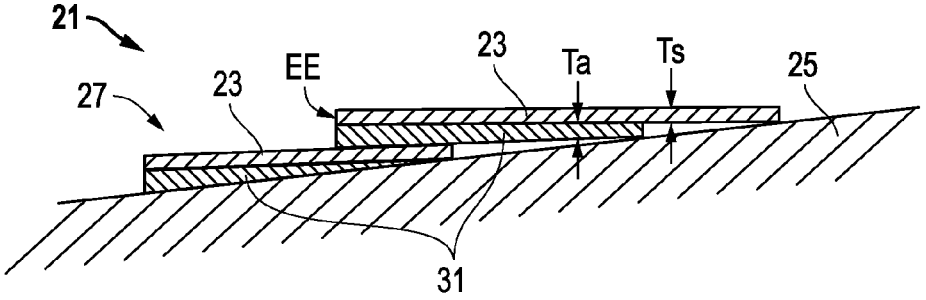

As shown in FIG. 1A, the exposed edge EE of the roofing shingle 23 may comprise one or more tabs 29 (e.g., four shown). Versions of the accessory 31 may be located under all of the one or more tabs 29. However, the accessory 31 may not be located under all of one or more tabs 29. The accessory 31 may be located under less than an entirety of the roofing shingle 23. Some types of the accessory 31 may be located beneath an entirety of the exposed edge EE of the roofing shingle 23. The accessory 31 also may be located beneath an exposure zone EZ of the roofing shingle 23. The exposure zone EZ may comprise that portion of the roofing shingle 23 intended to be exposed to the environment after installation in roofing system 21. In another version, the accessory 31 may be located beneath at least one of a fastening zone FZ and a headlap portion HL of the roofing shingle 23. The fastening zone FZ may comprise that portion of roofing shingle 23 through which fasteners (e.g., screws, nails, etc.) are intended to attach it to the roof deck 25. The headlap portion HL may comprise that portion of roofing shingle 23 intended to be overlapped by an upper course of roofing shingle 23. In some shingle configurations, the headlap portion HL sometimes includes the fastening zone FZ, such that the headlap portion may include everything above the exposure zone EZ.

Embodiments of the accessory 31 may comprise a single layer of material. For example, the accessory 31 may comprise a stratum that differs from the roofing shingle 23. Other embodiments of accessory 31 may comprise a laminate of layers of materials. For example, the accessory 31 may comprise a plurality of strata 103, 105, 107 (i.e., three shown), which may be stacked and laminated together by adhesive. Each of the strata 103, 105, 107 may have a strata width SW1, SW2, SW3, respectively, that differs from the other strata.

Figure 2:
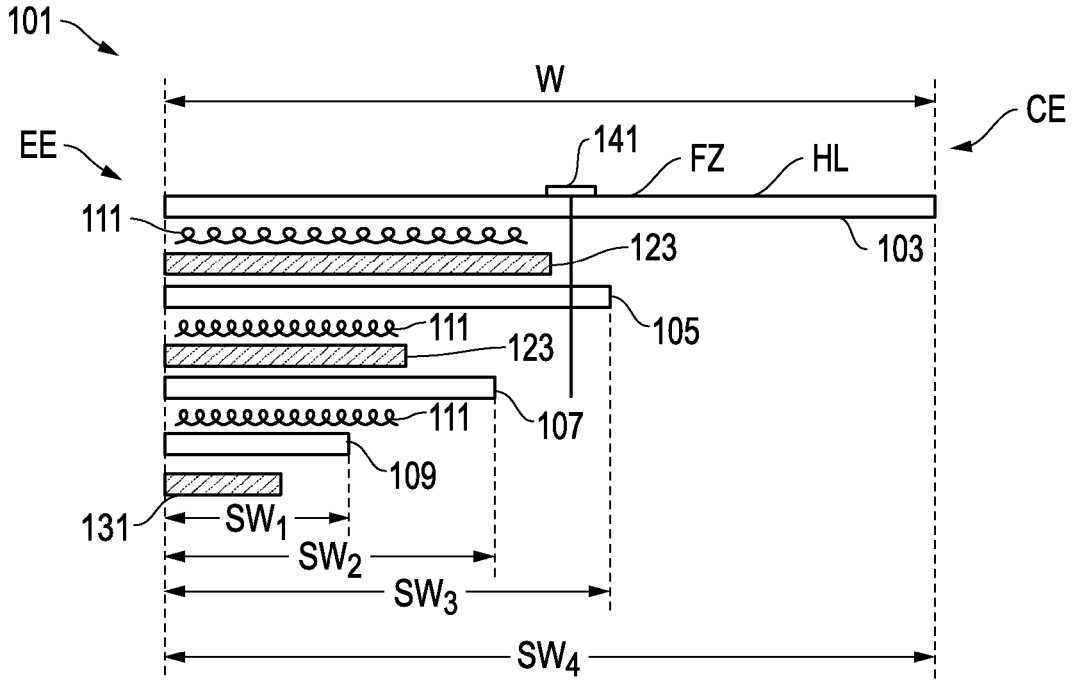
FIG. 2 is an exploded schematic side view of an embodiment of an accessory having a plurality of strata.

In the example of FIG. 2, an accessory 101 may comprise a plurality of strata 103, 105, 107, 109 (i.e., four shown) stacked and laminated together by adhesive 111. Each of the strata may have a strata width SW that differs from the other strata.

Figure 3:
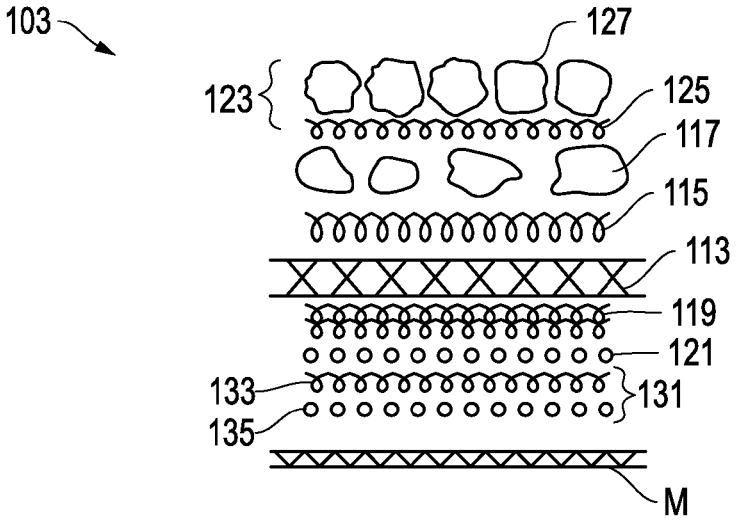
FIG. 3 is a schematic, exploded sectional side view of an embodiment of a stratum.

As shown in FIG. 3, each of the strata may comprise a plurality of layers. For purposes of this invention, a stratum may comprise two or more layers of different materials. For example, the layers may comprise a substrate 113, a top asphalt layer 115 on top of the substrate 113, granular matter 117 on the top asphalt layer 115, a bottom asphalt layer 119 on a bottom of the substrate 113, and mineral matter 121 on the bottom asphalt layer 119. The various strata may have identical compositions or different compositions. Although four strata are shown, the accessory 31 may comprise two to five strata in some embodiments, or more than five strata in other embodiments.

The strata have a strata length SL (FIG. 4) that is transverse to the strata width SW (FIG. 2) of each respective stratum. Each layer of each stratum may extend across an entirety of the strata length SL, other than cut outs CO, which are described elsewhere herein. Alternatively, the layers within the strata may vary in layer length and not extend for the entire strata length SL. In some embodiments, at least one of the strata is inverted such that layers of the inverted strata are reversed (e.g., vertically) relative to layers of another one of the strata.

Again referring to FIGS. 2 and 3, other embodiments may further comprise at least one overlay 123 on at least one of the strata 103, 105, 107, 109. Each overlay 123 may comprise an additional asphalt layer 125 (FIG. 3) on the granular matter 117, and additional granular matter 127 on the additional asphalt layer 125. The overlay 123 may be present on at least one stratum 105, 107, 109 that underlies the uppermost strata 103. In other embodiments, a plurality of overlays may be stacked on each other. The overlay 123 may have an overlay length OL (FIG. 4) that is equal to or less than a strata length SL on a respective one of the strata. The overlay may be evenly applied or applied to form a tapered wedge when viewed in section from the side of the accessory.

Any of these embodiments may further comprise at least one underlay 131 (FIGS. 2 and 3) on at least one of the strata. Each underlay 131 may comprise an additional asphalt layer 133 on the mineral matter 121, and additional granular matter or additional mineral matter 135 on the additional asphalt layer 133. Alternatively, the underlay 131 may comprise additional granular matter or particles of another dimension (not shown) in place of the additional mineral matter 135. The underlay 131 may be present on at least one stratum 105, 107, 109 that underlies the uppermost strata 103, and/or on the uppermost strata 103 as well. A plurality of the underlays 131 may be stacked on each other. The underlay 131 may have an underlay length UL (FIG. 4) that is equal to or less than a strata length SL on a respective one of the strata. The underlay may be evenly applied or applied to form a tapered wedge when viewed in section from a side of the accessory. The underlay 131 may be employed in conjunction with or independently from any overlay that may be employed.

Figure 4:
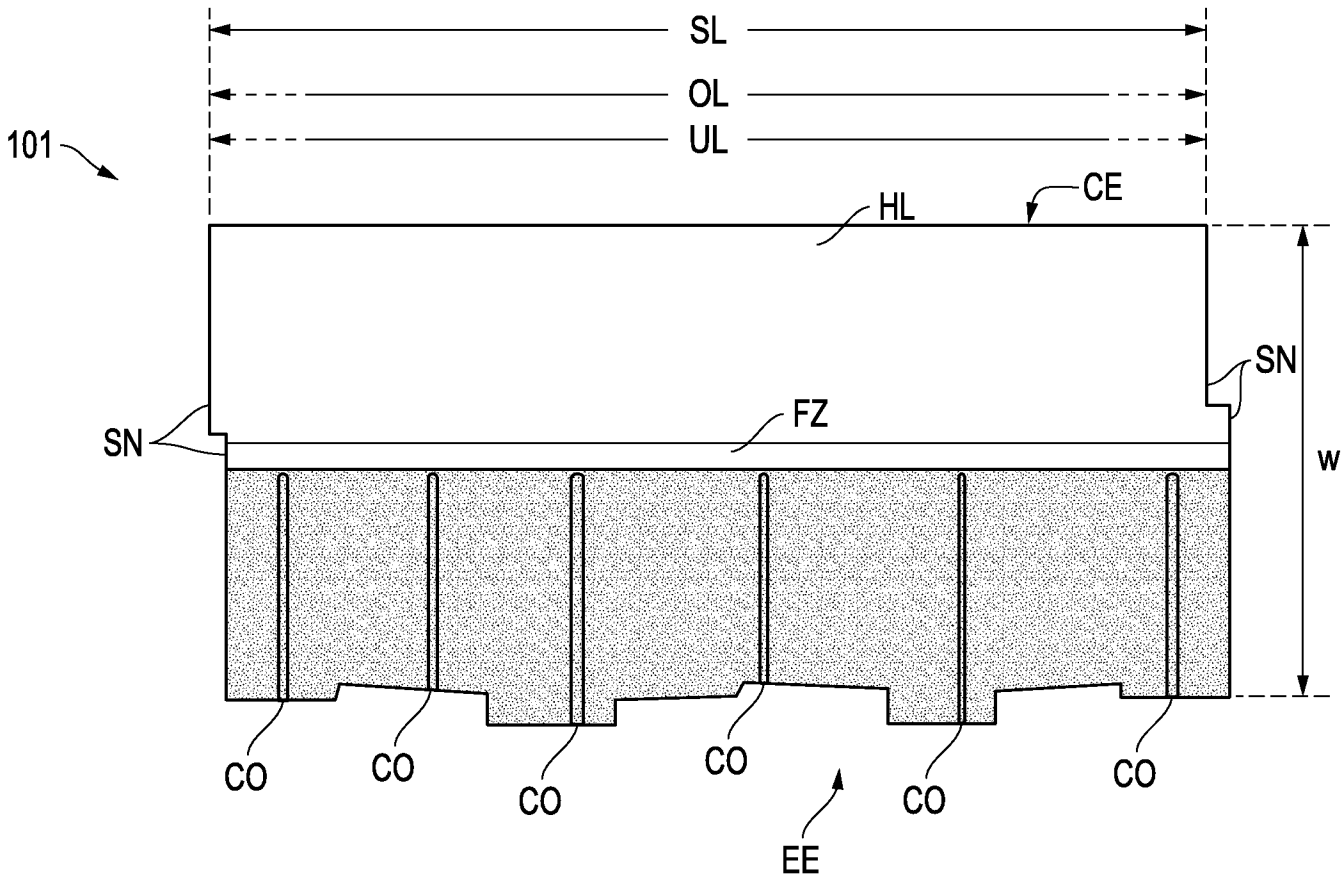
FIG. 4 is a top view of an embodiment of a final individual accessory.
Figure 5:
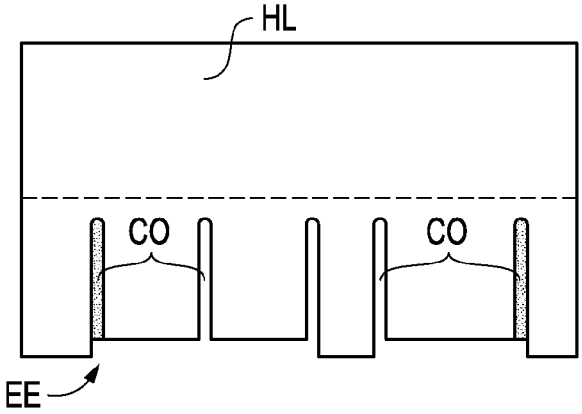
FIGS. 5-7 are top view of embodiments of accessories.
Figure 6:
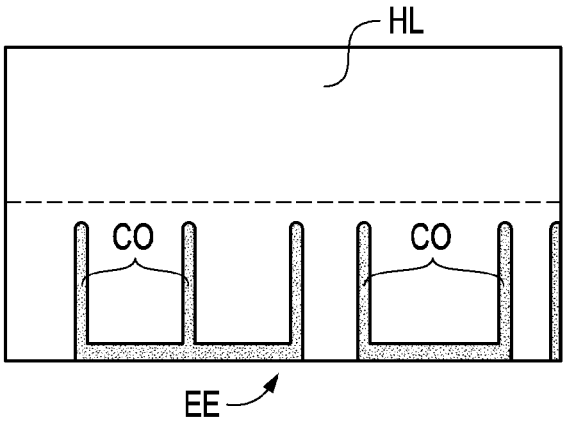
Figure 7:
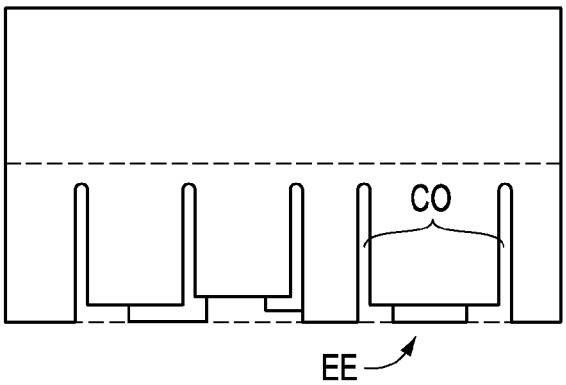

As shown in FIGS. 2 and 4, the roofing accessory 101 has an exposed edge EE and a covered edge CE. A width W of the roofing accessory may extend between the exposed edge EE and the covered edge CE. Likewise, the strata 103, 105, 107, 109 have strata exposed edges that are substantially aligned with the exposed edge EE (FIG. 2). The strata may be vertically arrayed in strata width SW from a greatest strata width at a top of the roofing accessory 101, to a least strata width at a bottom of the roofing accessory, such that the strata form a tapered lower surface in the width W direction on the roofing accessory.

As shown in FIGS. 2 and 4-7, the exposed edge EE may be straight (FIG. 2), or have at least some tabs that are angled, staggered or varied in shape or dimension. For example, a lower most one of the strata 109 (FIG. 2) may have a straight exposed edge EE (FIG. 6) that aligns with at least one other exposed edge of another strata or an overlying shingle 23.

The roofing accessory 101 may further comprise cut outs CO that extend from the exposed edge EE toward a headlap HL of the roofing accessory. The cut outs CO may vary in width and length. The cut outs CO may be formed only in an uppermost one 103 of the strata. The cut outs CO may be formed in at least two of the strata (FIG. 7) including the uppermost one of the strata. The cut outs CO may be non-aligned with the tabs formed in at least one of the strata as shown in FIG. 4.

Figure 8:
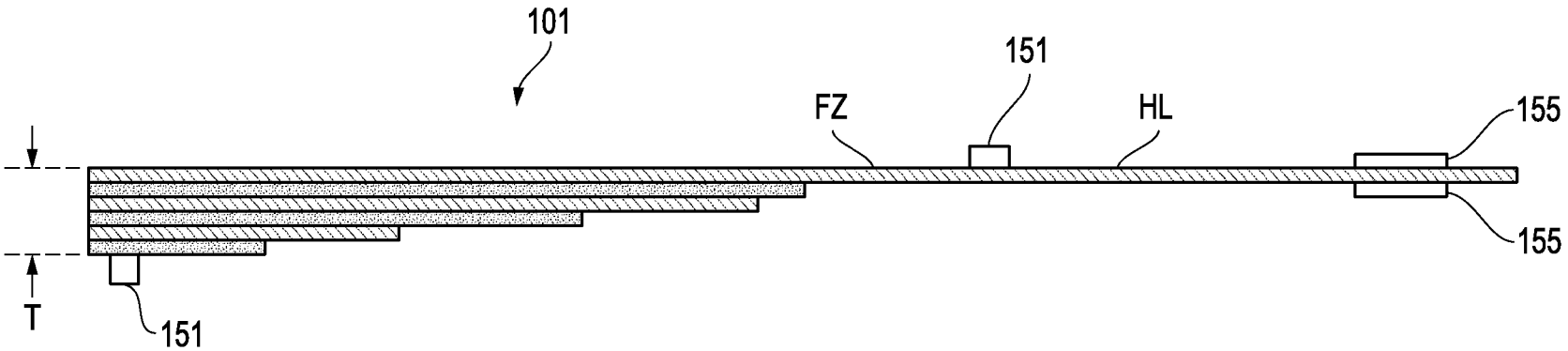
FIG. 8 is a sectional side view of an embodiment of an accessory.

As shown in FIG. 2, fasteners 141 are adapted to extend through at least two of the uppermost ones 103, 105 of the strata in a fastener zone FZ (FIG. 4). Some embodiments further comprise a sealant 151 (FIG. 8) on at least one of the strata, and a release layer 155 on at least one of the strata. For example, the sealant 151 may be on at least one of a lowermost one 109 of the strata and an uppermost one 103 of the strata, and the release layer 155 may be on at least one of a lower surface and an upper surface of a headlap HL of the uppermost one 103 of the strata. Alternatively, a release layer on one accessory may be provided and aligned with the sealant on another accessory when the accessories are stacked in a bundle so that they do not stick together in a package.

In some embodiments, the roofing accessory has a length SL (FIG. 4) with a thickness T (FIG. 8) that varies across the length. At least some of the layers (any component, element or portion; e.g., the adhesive, sealant, overlays or underlays) may be discontinuous in the length direction (e.g., SL, OL, UL, etc. in FIG. 4). The roofing accessory's width W (FIG. 2) also may have a thickness that varies in the width direction.

In some embodiments, the substrate 113 (FIG. 3) may comprise a fiberglass mat, polyester, organic felt or fiberglass polyester composite mat. The mineral matter 121 may comprise fine materials selected from the group consisting of sand, talc, powdered limestone, mineral granule fines, slate fines, slag fines, vitrified material fines, recycled mineral matter fines, or other non-mineral matter fines comprising polymeric, plastic or recycled polymer materials; or coarse materials selected from the group consisting of granular sand, talc, mineral granules, slate granules, slag, granular vitrified materials, granular limestone, or other non-mineral matter material comprising polymeric, plastic or foam. Other embodiments further comprise at least one reinforcing mesh M in or on at least one of the strata. In some embodiments, the reinforcing mesh M is in direct contact with either the bottom asphalt layer 119 or an additional asphalt layer 133 in place of or in addition to any particles or mineral matter.

Figure 9:
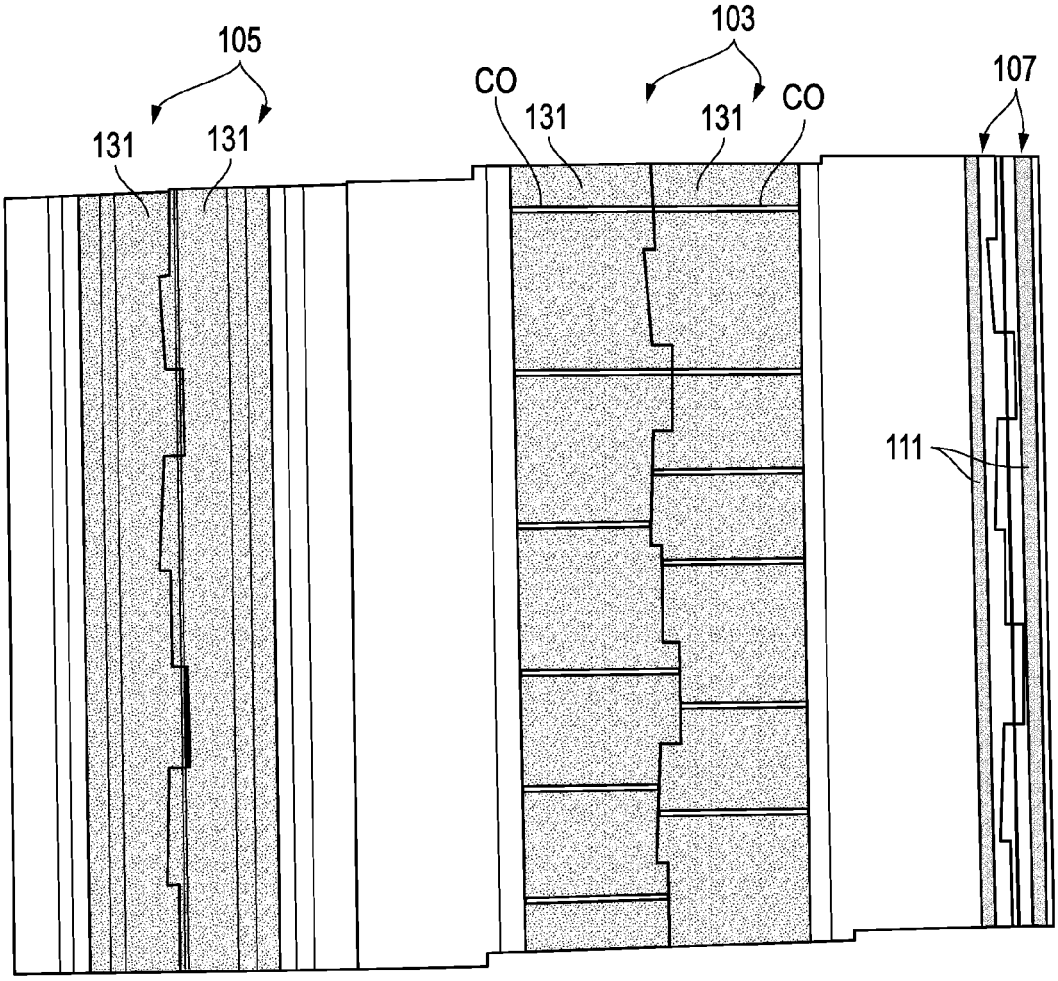
FIG. 9 is a top view of an embodiment of an overall sheet layout for production of a three strata roofing accessory.

Referring now to FIGS. 9-15, embodiments of a method or process of producing roofing accessories 101 are shown. FIG. 9 shows an overall sheet layout (before any cuts are made) for making a pair of "three strata" configurations from a single sheet of material. The single sheet initially comprises the raw substrate 113, which may be viewed in terms of "lanes" that will ultimately form the various strata. The cutouts CO are shown with the final accessory shape for reference purposes, but in actual production the final shape is formed in a later step before packaging. The cutouts CO are formed before the individual strata are combined on the production line. Prior to this step, any underlays 131 and/or overlays 123 are applied.

The left and middle shaded areas of FIG. 9 depicts where the underlays 131 may be applied when viewing through the sheet. The shading on the far right depicts the laminating adhesive 111 extending in the machine direction. The entire short width may have underlay 131 applied to it.

Figure 10:
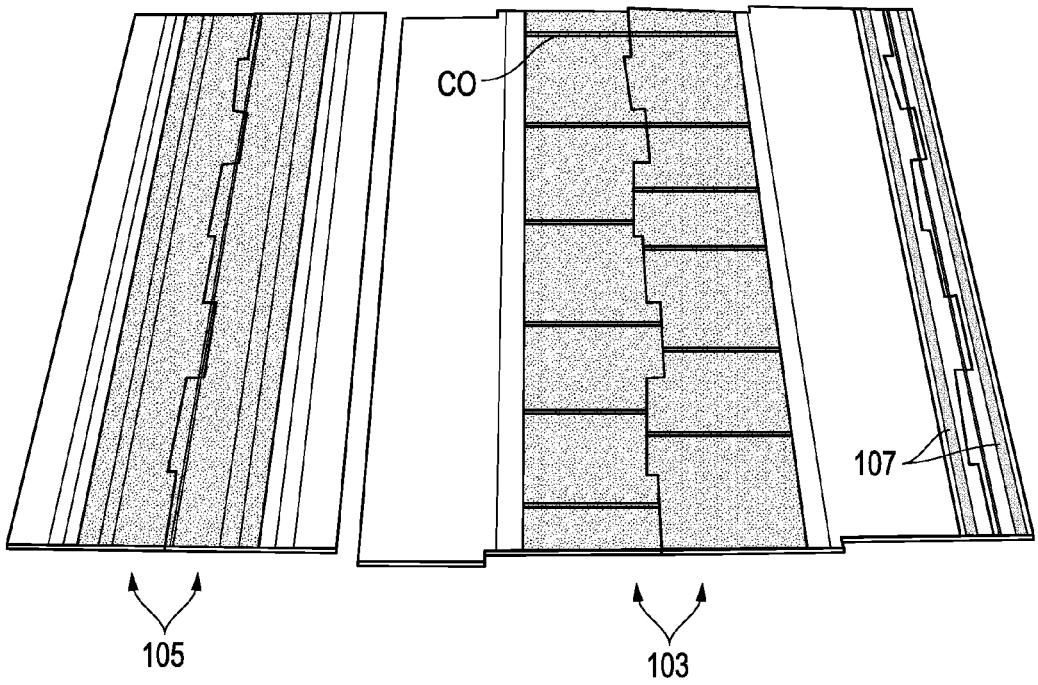
FIGS. 10-12 are sequential top views of embodiments of stages of assembly of the roofing accessory of FIG. 9.
Figure 11:
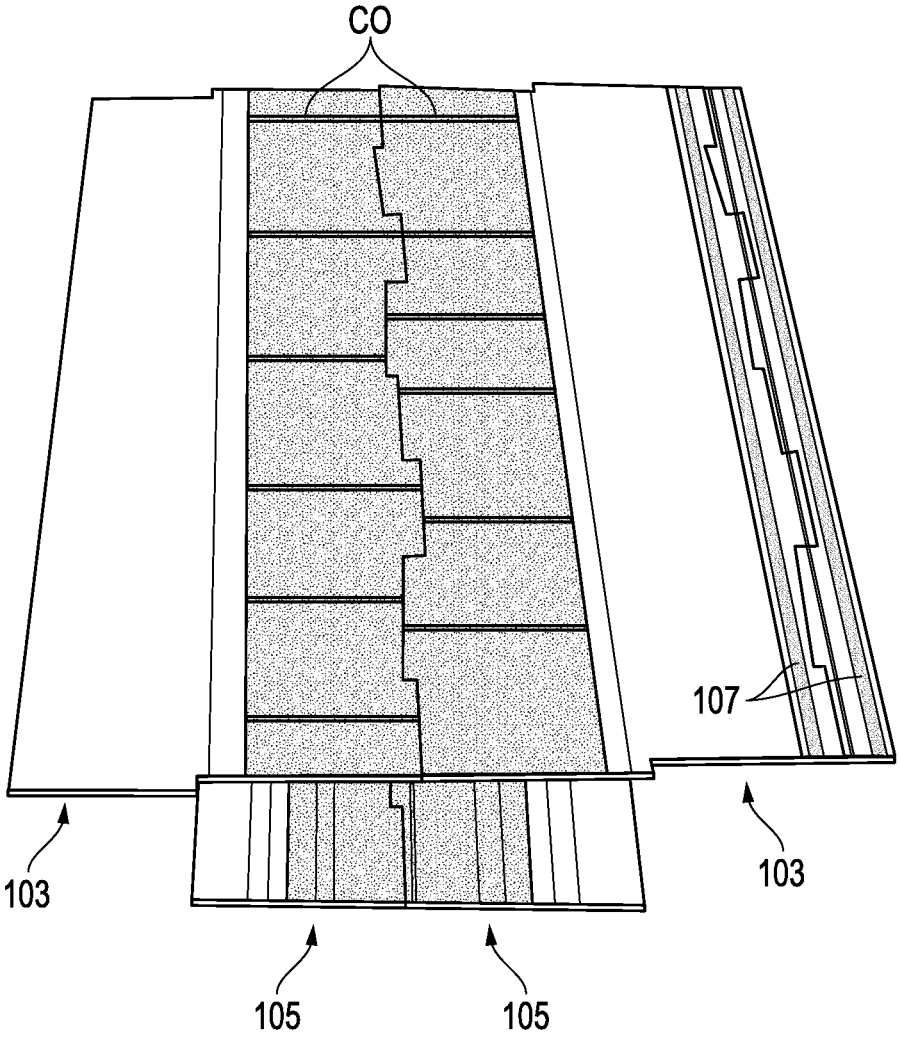
Figure 12:
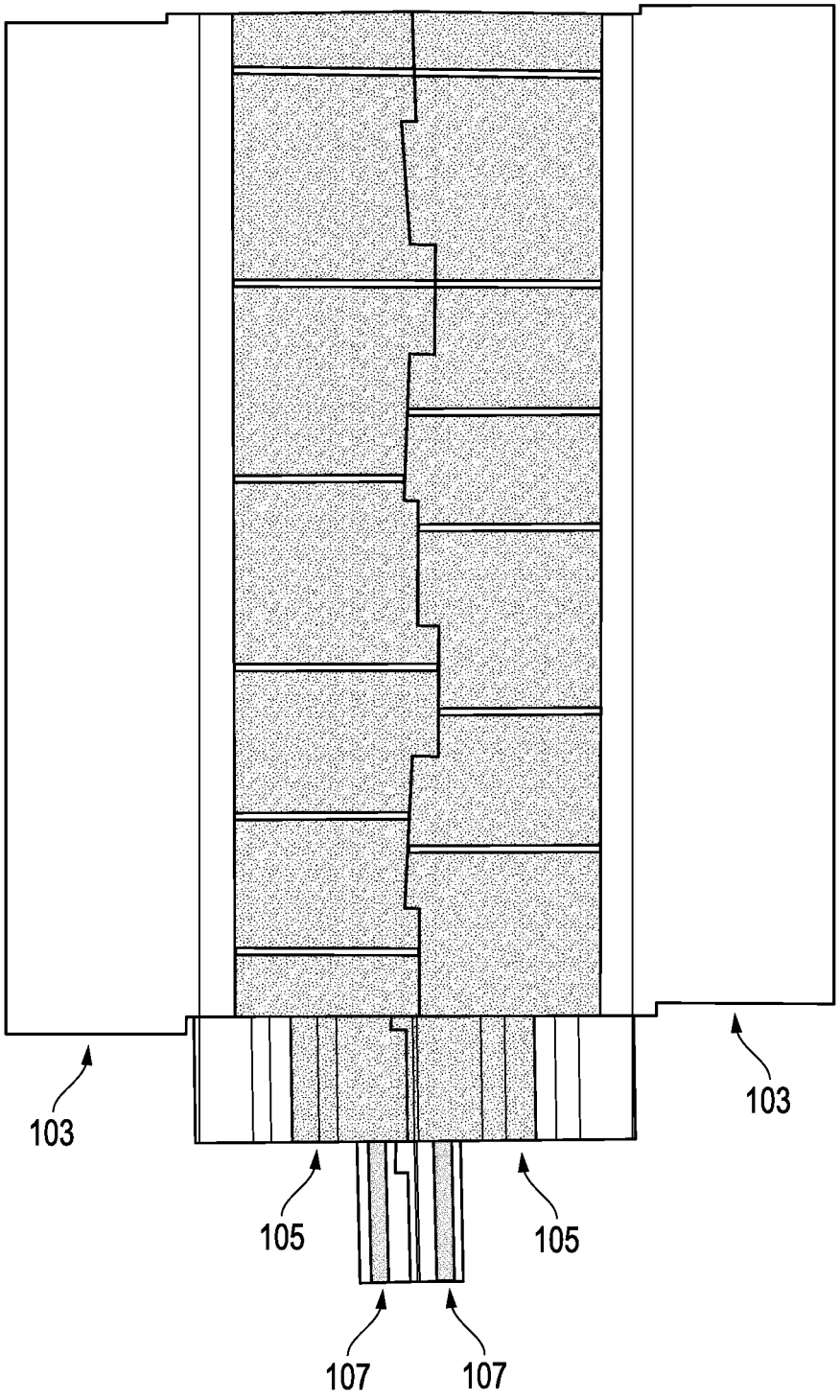

FIG. 10 shows the middle strata 105 cut from the main sheet body. They are placed under the top strata 103 (FIG. 11). In this embodiment, the top two cutouts CO of FIG. 9 that directly oppose each other provide a synchronizing reference point that repeats every second accessory length in the final cut pattern. In an alternate embodiment (not shown), the synchronizing reference point repeats at a different, predetermined frequency that may be an integer number of accessory lengths in the pattern, or a predetermined frequency that includes a fractional accessory length aspect.

Figure 16:
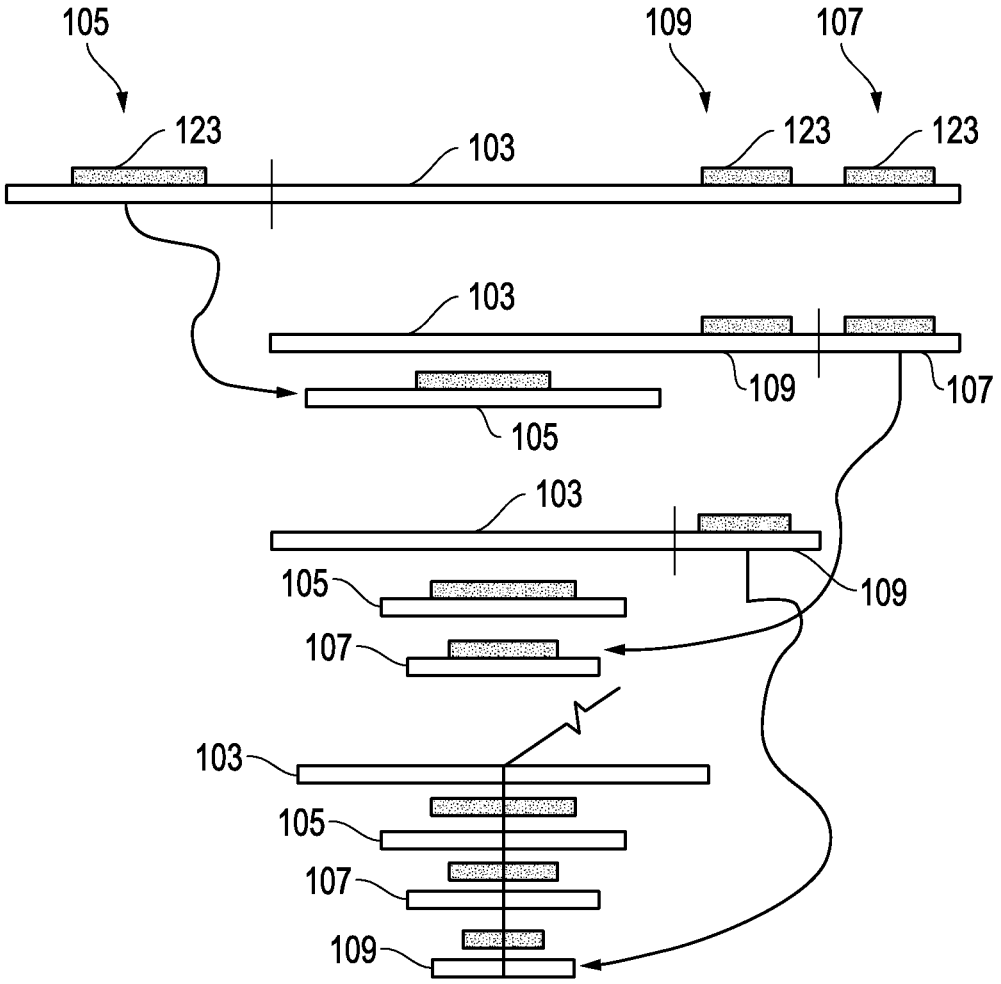
FIG. 16 is a schematic end view of an embodiment of a process for manufacturing an accessory.

Alternatively, an opposing set (i.e., left accessory to right accessory) of cutouts CO also may be used if a wider cutout width is used. In FIG. 11, the lowermost strata 107 are not yet cut from the sheet body, but are subsequently stacked and positioned beneath the top two strata 103, 105 (FIG. 12) as shown. FIG. 16 depicts a similar sequence of steps for forming, cutting and assembling embodiments of a pair of "four strata" accessories.

Figure 13:
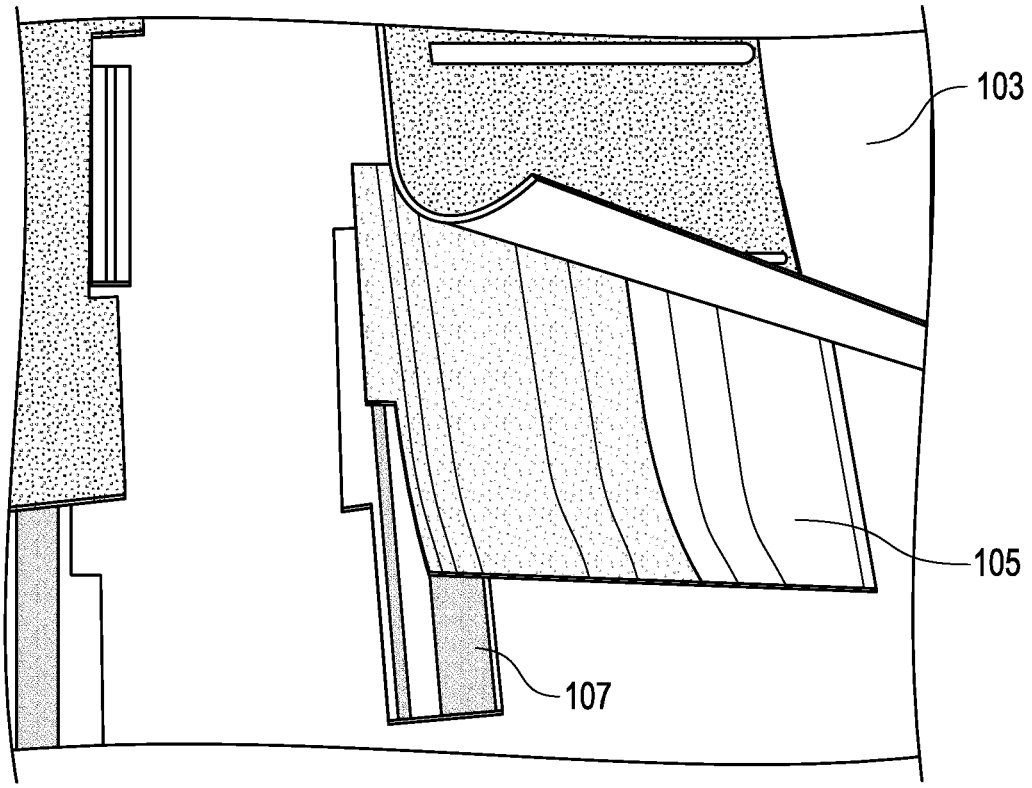
FIG. 13 is a top view of an embodiment of an assembly showing a three strata configuration and a layout of a laminating adhesive location.
Figure 14:
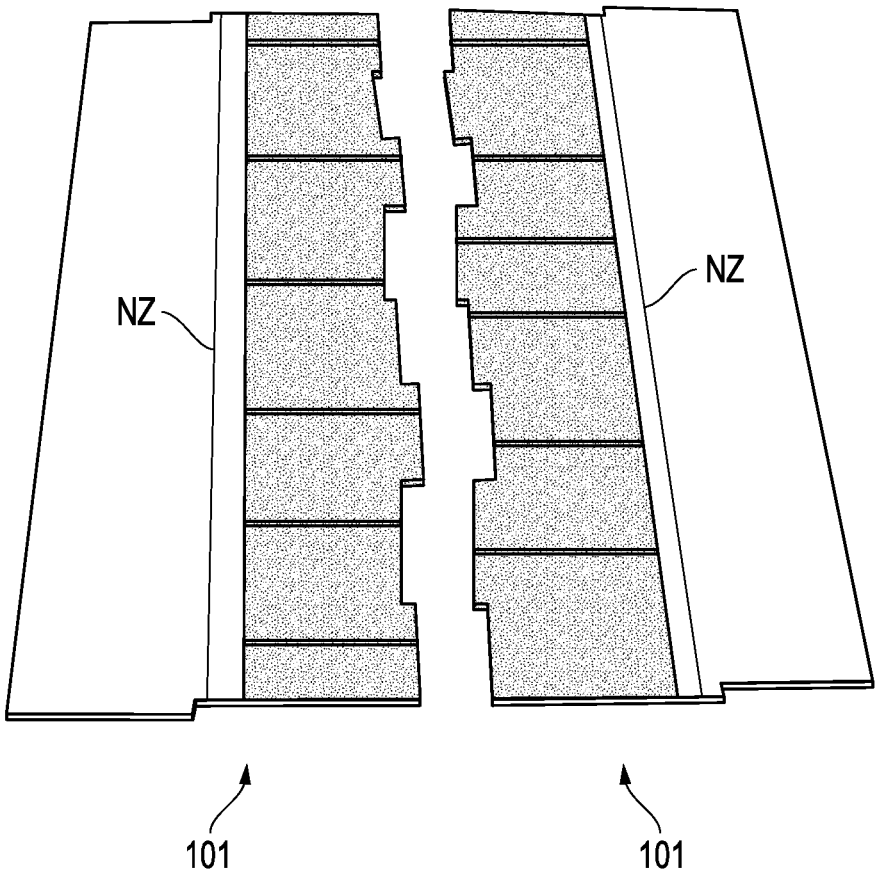
FIG. 14 is a top view of an embodiment of a final sheet cut of individual accessories that are paired apart after assembly.

FIG. 13 is a schematic view of an assembly of a three strata configuration and a layout of locations for laminating adhesive. FIG. 14 shows a final sheet cut for a pair of individual accessories 101 that are cut apart after assembly (underlying strata not shown). The nail zone NZ locations extend in the machine direction all the way to outside edges of the shaded area. Again, the shaded area depicts underlay 123 and is shown only for illustrative purposes and how it would appear if it were visible through the sheet.

Figure 15:
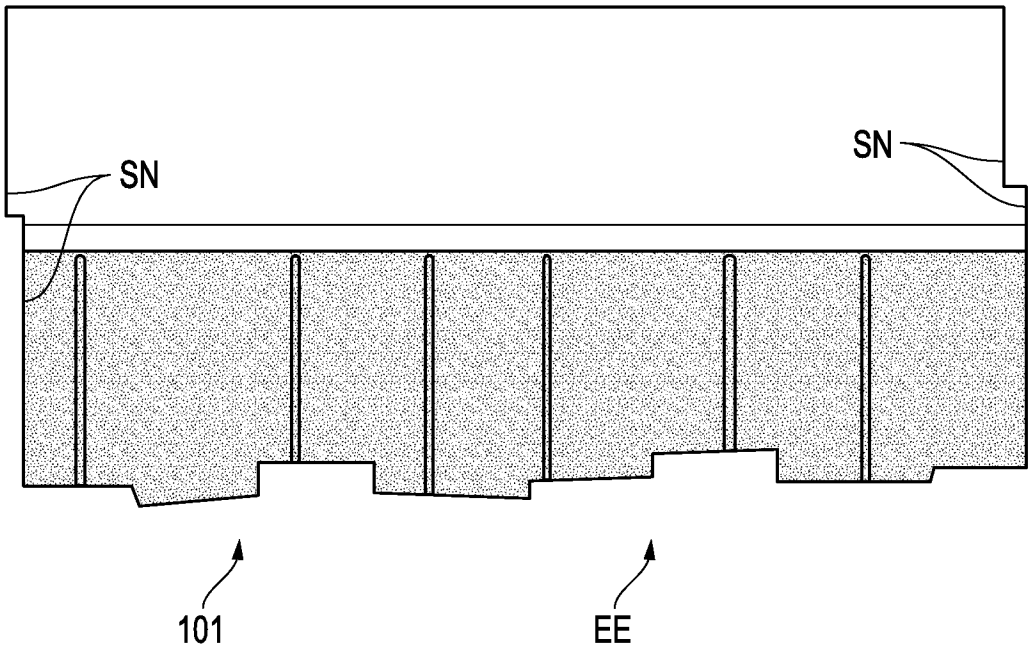
FIG. 15 is a top view of an embodiment of a final individual accessory of FIG. 9.

FIGS. 4 and 15 show schematic views of embodiments of the two, complementary-shaped accessories 101. Accessories 101 are shown with optional side notches SN that may be used for alignment during installation on the roof of a building. The exposed edge EE is illustrated with some lower edges tapered at an angle and some orthogonal or horizontal for desired aesthetics. The angles also have a functional feature in that they permit an aesthetic look of length variation, but allow cutting of the accessories more easily for separation. The angles and corners allow a more generous corner radius, which makes them easier to cut and tool, extends the life of tooling, is more production friendly, and runs faster. Although there are seven tabs shown on each accessory, another option is to have a combination of six and seven tabs for opposing accessories. A greater or lesser number of tabs for opposing accessories also may be provided depending on desired shapes and the length of the accessory.

An advantage of using asphalt based accessory roofing products is lesser cost over more expensive but natural materials such as quarried slate or split wood or sawn shakes that have inherent and desired thickness. Traditional asphalt roofing products are much thinner and less in weight than natural materials. Asphalt accessories also simulate a plurality of pieces of natural materials, thus enabling faster, more efficient coverage of a roof area with fewer individual pieces.

Another advantage is that a single type of accessory can work with a variety of shingles, which reduces SKU requirements. For example, one accessory shape can work with a variety of colors of a single design. In addition and/or alternatively, a single accessory can work with a variety of shingle sizes, shapes and/or designs.

The wedged shaped multilayer asphalt accessory described herein may use overlay technology and pre-designed laminated staggered layers to achieve the desired edge thickness and look of natural wood or sawn shakes while conserving material use and allowing efficient packaging to the job site. Along with roofing shingles, these accessories simulate the shape and appearance of real wood or sawn shakes in design and using granule color blending.

The accessory design is based in general on a typical asphalt sheet where a membrane of fiberglass mat or similar material is coated with an asphaltic material on the top and bottom sides and generally within the body of the membrane. Mineral granules that may be of various color combinations are typically added to the top surface and mineral matter such as sand is typically added to the bottom surface, but granular material may also be used by product design.

The coated asphalt sheet described above may be further processed so as to add an "overlaid" additional layer or layers of asphaltic material or the like on one or more portions or layers adhered together and generally mineral matter to predetermined designated locations either the top surface (overlay) or bottom surface (underlay) or both top (overlay) and bottom (underlay) surfaces of a strata.

The coated asphalt sheet still in process may be cut into smaller lanes that are then positioned and combined together. The smaller lanes may be further processed with the option to have portions cutout, the option to have an edged surface cut design, adhesive added to combine portions and a separate adhesive added to either the top or bottom surface in order to adhere whole accessories together on a roof once applied. A release tape or agent may also be applied to either surface. The whole assembly may then be cut into the final shape and design and packaged.

Embodiments of a method of installing a roof may comprise placing an accessory 31 in a location where a next roofing shingle 23 is to be installed (e.g., with or without fasteners). The method may comprise installing the next roofing shingle 23 on top of the accessory 31, such that the accessory 31 adds a thickness (e.g., at least about 1.5 mm) to at least a portion of the exposed edge EE of the roofing shingle 23. The method also may comprise repeating these steps for each roofing shingle 23. Other embodiments of the method may comprise placing the accessory 31 without fasteners, and installing the next roofing shingle 23 and the accessory 31 with fasteners. The method may further comprise, prior to placing the accessory 31, installing a course of starter shingles on a roof deck 25, and then placing the accessory 31 on at least one of the starter shingles.

Embodiments of a roofing kit may comprise a plurality of roofing accessories 31 that are not roofing shingles 23 and are not an outermost layer of a roofing system 21. Each of the roofing accessories 31 may be configured to be secured between a roofing shingle 23 and a previous course 27 (FIG. 1C) of roofing shingle 23 for adding a thickness (e.g., at least about 1.5 mm) to at least a portion of an exposed edge EE of the roofing shingle 23.

Still other embodiments may comprise a roofing product including a roofing accessory 31 that is not a roofing shingle 23 and is not an outermost layer of a roof. The roofing accessory 31 may be configured to be secured between a roofing shingle 23 and a previous course 27 of roofing shingle 23 for adding a thickness of at least about 1.5 mm to at least a portion of an exposed edge EE of the roofing shingle 23.

The following patents and published applications are incorporated herein by reference in their entirety: U.S. Pat. No. 6,920,730, U.S. Pat. No. 5,488,807, U.S. Pat. No. 7,781,046, U.S. Pat. No. 8,592,025, U.S. Pat. No. 5,347,785, U.S. Pat. No. 8,365,493, US 20090151288A1, US 20100266811A1 and US 20120260597A1.

This written description uses examples to disclose the embodiments, including the best mode, and also to enable those of ordinary skill in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes may be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. A roofing system, comprising:

a roofing shingle configured to be secured to a roof deck as an outermost layer of a roof, the roofing shingle having a headlap at an upper end thereof, an exposed edge opposite the headlap at a lowermost end thereof, and side edges; and an accessory with a substantially flat upper surface, the accessory is not a part of and is manufactured separately from the roofing shingle, and the accessory is configured to be secured between the roofing shingle and a previous course of roofing shingle for adding a thickness of at least about 1.5 mm to at least a portion of the exposed edge of the roofing shingle at the lowermost end thereof, such that an exposed edge EE of the accessory at a lowermost end thereof is exposed to an exterior of the roofing system; and the accessory has a covered edge CE at an uppermost end thereof that is configured to be covered by the roofing shingle, and a width W that extends from the covered edge CE to the exposed edge EE, and the accessory comprises a tapered wedge that thickens from the covered edge CE to the exposed edge EE.

2. The roofing system of claim 1, wherein the accessory is thicker than the roofing shingle, the accessory is thickest at the exposed edge EE at the lowermost end of the accessory, and the accessory is not configured to be an outermost layer of the roofing system and is not suitable for use as a roofing shingle.

3. The roofing system of claim 1, wherein the accessory is configured to be used with a plurality of different types of roofing shingles, each of which differs from the others in at least one aspect, and the accessory is not a roofing shingle.

4. The roofing system of claim 1, wherein the accessory is located beneath an entirety of the exposed edge of the roofing shingle, and the accessory is not a starter shingle.

5. The roofing system of claim 1, wherein the accessory comprises a stratum that differs from the roofing shingle, the accessory is not connected to the roofing shingle, and the accessory only contacts the roofing shingle upon installation of the roofing shingle on the roof.

6. The roofing system of claim 1, wherein the exposed edge EE of the accessory protrudes beyond the exposed edge of the roofing shingle.

7. The roofing system of claim 1, wherein the accessory has a thickness that is an integer multiple of a thickness of the roofing shingle.

8. The roofing system of claim 1, wherein the exposed edge EE of the accessory does not conform to the exposed edge of the roofing shingle.

9. The roofing system of claim 1, wherein the accessory has one or more decorative portions DP exposed from an exterior of the roofing system.

10. The roofing system of claim 9, wherein said one or more decorative portions DP of the accessory are exposed through one or more of a slit, slot and cut out in the roofing shingle.

11. A method of installing a roof, comprising:

(a) providing an accessory with a substantially flat upper surface and a tapered wedge shape, the accessory is not a roofing shingle and is not a part of a roofing shingle, and placing the accessory in a location where a next roofing shingle is to be installed; then (b) installing the next roofing shingle on top of the substantially flat upper surface of the accessory, such that the accessory adds a thickness of at least about 1.5 mm to at least a portion of the exposed edge of the roofing shingle at a lowermost end thereof, and an exposed edge EE of the accessory at a lowermost end of the accessory is exposed to an exterior of roof; and then (c) repeating steps (a) and (b) for each roofing shingle.

12. The method of claim 11, wherein the accessory is not configured to be an outermost layer of the roofing system and is not suitable for use as a roofing shingle, and wherein step (a) comprises placing the accessory without fasteners, and step (b) comprises installing the next roofing shingle and the accessory with fasteners; and each accessory has a covered edge CE at an uppermost end thereof that is configured to be covered by a respective one of the roofing shingles, and a width W that extends from the covered edge CE to the exposed edge EE, and the accessory comprises a tapered wedge that thickens from the covered edge CE to the exposed edge EE.

13. The method of claim 11, wherein the accessory is thicker than the roofing shingle, the accessory is thickest at the exposed edge EE, and the accessory is not a starter shingle.

14. The method of claim 11, wherein the accessory is not connected to the roofing shingle, and the accessory only contacts the roofing shingle upon installation of the roofing shingle on the roof.

15. The method of claim 11, wherein the exposed edge EE of the accessory does not conform to the exposed edge of the roofing shingle, and the accessory has one or more decorative portions DP exposed from an exterior of the roofing system.

16. A roofing kit, comprising:

a plurality of roofing accessories that are not roofing shingles, are not a part of and are manufactured separately from roofing shingles, the roofing accessories are not connected to roofing shingles, are not suitable for use as roofing shingles, only contact roofing shingles upon installation of roofing shingles on a roof, and are not an outermost layer of a roofing system, each of the roofing accessories has a substantially flat upper surface, a tapered wedge shape that is thickest at a lowermost exposed edge EE thereof, and is configured to be secured between a roofing shingle and a previous course of roofing shingle for adding a thickness of at least about 1.5 mm to at least a portion of an exposed edge of the roofing shingle at a lowermost end thereof, such that only exposed edges EE at lowermost ends of the accessories are exposed to an exterior of the roof after the accessories are installed on the roof.

17. The roofing kit of claim 16, wherein the exposed edge EE of the accessory does not conform to the exposed edge of the roofing shingle, and the accessory has one or more decorative portions DP exposed from an exterior of the roofing system; and the accessory has a covered edge CE at an uppermost end thereof that is configured to be covered by the roofing shingle, and a width W that extends from the covered edge CE to the exposed edge EE, and the accessory comprises a tapered wedge that thickens from the covered edge CE to the exposed edge EE.

18. The roofing kit of claim 17, wherein said one or more decorative portions DP of the accessory are exposed through one or more of a slit, slot and cut out in the roofing shingle.

* * * * *